US005575274A

United States Patent [19]

DePalma

[11] Patent Number: 5,575,274

[45] Date of Patent: Nov. 19, 1996

[54] GAS LOG FIREPLACE SYSTEM

[76] Inventor: Thomas M. DePalma, HCR Box 54A, Central Bridge, N.Y. 12035

[21] Appl. No.: 399,179

[22] Filed: Mar. 6, 1995

Related U.S. Application Data

[63] Continuation-in-part of Ser. No. 100,487, Jul. 30, 1993, Pat. No. 5,503,550.

[51] Int. Cl.[6] ..... F24C 3/12

[52] U.S. Cl. ..... 126/512; 126/502; 126/503; 126/504; 126/285 R; 431/77; 431/20; 431/22

[58] Field of Search ..... 126/285 R, 307 A, 126/502, 503, 504, 512; 431/16, 20, 22, 77, 78, 80; 236/1 G

[56] References Cited

U.S. PATENT DOCUMENTS

| | | | |
|---|---|---|---|
| Re. 31,256 | 5/1983 | Schmidt | 126/307 A |
| 506,331 | 10/1893 | McGahan . | |
| 2,007,292 | 7/1935 | Carleton . | |
| 2,709,486 | 5/1955 | Kik . | |
| 3,086,583 | 4/1963 | Reichow . | |
| 3,236,450 | 2/1966 | Bixby et al. . | |
| 3,537,803 | 11/1970 | Ignazio . | |
| 4,019,491 | 4/1977 | DiRocco | 126/120 |
| 4,102,628 | 2/1978 | Goff et al. . | |
| 4,160,441 | 7/1979 | Fuller . | |
| 4,242,078 | 12/1980 | Nelson et al . | |
| 4,270,894 | 6/1981 | Moore, Jr. et al. | 431/20 |
| 4,401,425 | 8/1983 | Gable et al. . | |
| 4,457,692 | 7/1984 | Erdman . | |
| 4,503,836 | 3/1945 | Evans . | |
| 4,573,446 | 3/1986 | Roster et al. . | |
| 4,726,351 | 7/1988 | Whittaker et al. . | |
| 4,760,836 | 8/1988 | Witzel . | |
| 4,773,322 | 12/1988 | Shimek et al. . | |
| 4,838,240 | 6/1989 | Rieger . | |
| 4,949,705 | 8/1990 | Smith . | |
| 4,951,870 | 8/1990 | Ballard et al. . | |
| 4,962,750 | 10/1990 | Bridgewater . | |
| 4,971,030 | 11/1990 | Thow et al. | 431/125 X |
| 5,000,162 | 5/1991 | Shimek et al. | 126/512 |
| 5,239,980 | 8/1993 | Hilt et al. | 126/116 A |

FOREIGN PATENT DOCUMENTS

| | | |
|---|---|---|
| 2623881 | 6/1989 | France . |
| 7414831 | 5/1976 | Netherlands . |
| 2043874 | 10/1980 | United Kingdom . |

OTHER PUBLICATIONS

Installation Manual for Honeywell Pilotless Ignition System, Sep. 1987.

*Primary Examiner*—Carl D. Price

*Attorney, Agent, or Firm*—Schmeiser, Olsen & Watts

[57] ABSTRACT

A gas-fired, simulated log fireplace insert incorporating an automatic flue damper for controlling the operational state of a chimney vent (open/closed) in response to gas combustion, an externally mounted carbon monoxide detector for terminating or inhibiting gas combustion in response to an unsafe level of detected carbon monoxide and a temperature actuated switch, disposed within the firebox area of the fireplace proximate the flue, for terminating gas combustion in response to excessive fireplace temperatures caused by a malfunctioning damper.

9 Claims, 7 Drawing Sheets

FIG. 4
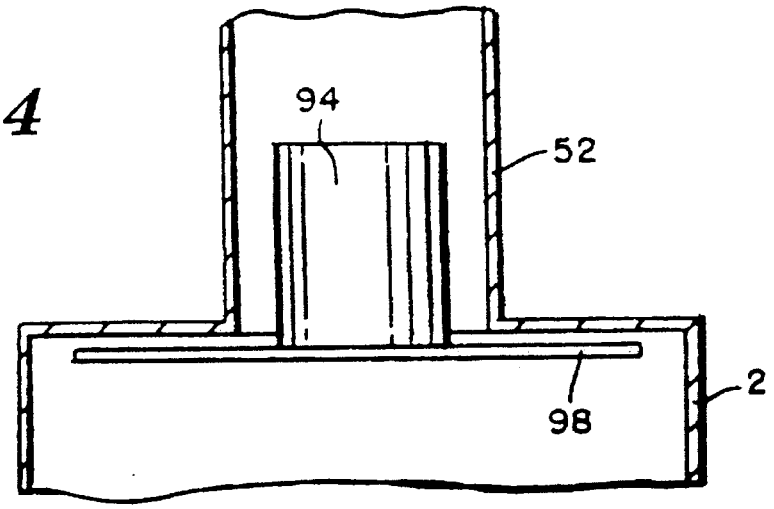
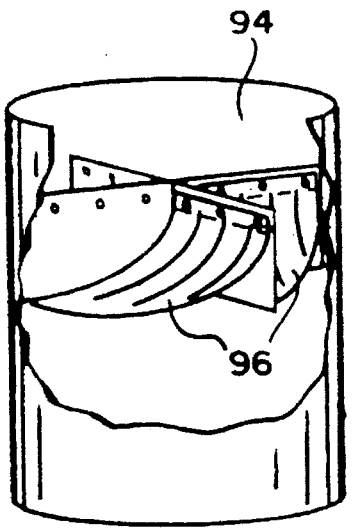
FIG. 5
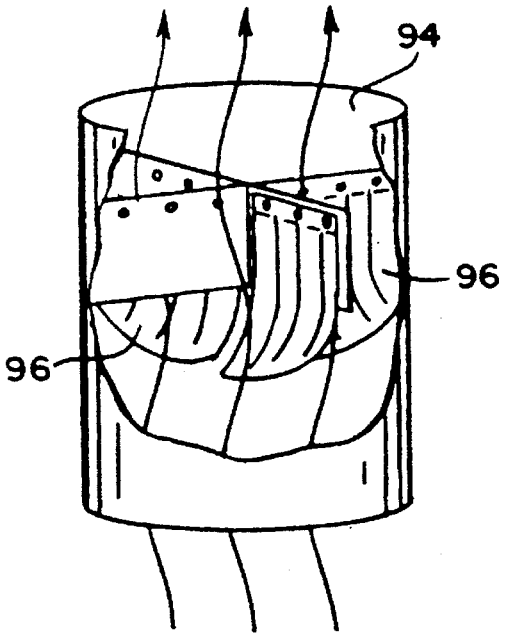
FIG. 6

GAS LOG FIREPLACE SYSTEM

CROSS-REFERENCE TO RELATED APPLICATIONS

This application is a continuation-in-part of U.S. patent application Ser. No. 08/100,487, filed Jul. 30, 1993, now U.S. Pat. No. 5,503,550 and entitled Gas Log Fire Place.

FIELD OF THE INVENTION

The present invention relates to fireplace devices and, more particularly, to a gas-fired, simulated log fireplace insert incorporating an automatic flue damper for controlling the operational state of a chimney vent (open/closed) in response to gas combustion and an externally mounted carbon monoxide detector for terminating or inhibiting gas combustion in response to an unsafe level of detected carbon monoxide. The invention is aesthetically attractive, extremely safe to operate and capable of acting as a significant source of heat.

BACKGROUND OF THE INVENTION

Many people, especially those who reside in cold climates, enjoy having a wood burning fireplace in their homes. Unfortunately, a tremendous degree of manual labor must be expended to provide the requisite firewood associated therewith. Further, the problems associated with lighting the fire, the fire hazard from sparks and the removal of ashes are often disliked by the owners of wood burning fireplaces. As such, a wide variety of gas-fired substitute units have been developed which provide many of the same aesthetic properties of wood burning fireplaces without the concomitant problems.

Typical gas-fired fireplace units normally comprise a natural gas inlet line that leads to a gas manifold located within the firebox of the fireplace. The inlet line passes through the firebox containment bricks or metal liners and will normally include at least one main flow valve and a valved tap for a standing pilot. These valves and any associated electronic controls are placed either in the containment material or within the firebox itself. To complete the unit, a number of simulated, ceramic logs are placed atop the manifold. When the device is lit, flames from the manifold pass upwardly through the logs, thereby simulating the typical flame pattern of a traditional wood burning fireplace.

Although this type of fireplace installation eliminates many of the above-detailed disadvantages of wood burning fireplaces, it suffers from a plethora of problems relative to the lighting and combustion of the gas supply.

In many states, standing pilot lights are being made illegal due to the associated fire hazard. In addition, the standing pilot light is economically unsatisfactory due to its continuous depletion of fuel. One recently employed method of avoiding a standing pilot light has been the addition of a wall switch actuated piezo electric igniter for the pilot, wherein the electronics for the igniter are placed within the firebox containment region. This alleviates the standing pilot problem with newer units that have double wall or similar containment areas that can receive the electronic components. However, there are no similar solutions available for retrofit units that are placed in existing brick fireplaces that do not have double wall or similar construction that can receive the electronic components. By making the electronics part of the fireplace, the prior art also prevents the unit's use as a significant heat source due to the deleterious effect the higher heat output would have on the electronic components. A typical prior art device of this type can produce a heat output on the order of 28,000 BTU's.

Many of the newer gas-fired fireplace units also include an electronically controlled gas inlet valve. This allows a user to simply flip a switch to automatically light the entire unit (both the pilot and the manifold). A problem arises since a fireplace is unlike typical home appliances in that it requires a movable damper in its flue. If a user turns on the unit without first manually opening the damper, a potentially serious and hazardous overheating condition can result since the combustion gases cannot escape up through the flue.

SUMMARY OF THE INVENTION

In order to avoid the disadvantages of the prior art, the present invention incorporates an automatic flue damper and an externally mounted carbon monoxide detector into a retrofitted, gas-fired, simulated log fireplace insert system. These features provide an improved unit that can be readily and safely retrofitted into an existing fireplace.

The present invention includes a gas burner apparatus that is designed to be installed (retrofitted) into a conventional fireplace or prefabricated fireplace of brick or other refractory material construction. As known in the art, such conventional brick or prefabricated fireplaces generally include a square or rectangular firebox area having a floor composed of brick or the like and three surrounding brick walls, wherein the brick walls extend upward, thereby forming the flue and chimney of the fireplace. Normally, the fireplace flue is located at the top of the firebox area and includes a manually controlled damper.

The gas log fireplace system of the present invention includes a gas manifold that is attached to the home's gas-line by an inlet pipe. The inlet pipe extends out of the firebox via a hole which has been suitably established in one of the brick walls that surround the firebox. The outer portion of the inlet pipe extends exterior to the brick containment and includes an electrically actuated flow valve and a tap for a pilot light that also includes an electrically actuated flow valve. A computerized igniter/controller module is also located exterior to the firebox brick containment and is used to actuate the valves and ignite the pilot. A wall mounted switch is provided which allows a user to control the igniter/controller in a simple manner. Unlike prior art retrofit devices of this type, a standing pilot light is not required.

An additional feature of the invention that greatly enhances the safety of the unit is a temperature actuated electrical switch which is mounted at a distance from the manifold. The temperature actuated switch is connected to the igniter/controller by heat resistant wiring and is located above the gas manifold proximate the flue.

The temperature actuated switch is used to detect conditions that would be caused by the unit operating when the flue is closed. When the unit is operating normally with the flue open, the air temperature in the region of the flue opening is less than 400° F. However, if the unit is operating with the flue closed, the temperature in the same region will exceed 400° F. Should the latter condition occur, the temperature actuated switch automatically initiates a disruption in the electrical power supplied to the igniter/controller, thereby causing the main flow and pilot valves to move to their closed, no-flow position. This completely shuts down the unit.

The use of a temperature actuated electrical switch in lieu of other mechanisms is critical due to the harsh conditions normally found in the area of the firebox. Mechanical devices can become easily jammed by soot, tar and ash buildup. The electronic nature of the temperature actuated switch allows it to operate even if its exterior becomes coated with the same products.

As described above, an overheating condition may occur when a manually actuated damper is inadvertently maintained in a closed position during combustion. As such, the gas log fireplace system of the present invention incorporates an automatic, thermostatically controlled, electric damper (such as the SL19 manufactured by FLAIR INTERNATIONAL CORPORATION) which is adapted to automatically close when the burner is off and to fully open when combustion is required. The automatic damper closes when the burner is off to prevent loss of heated air to thereby save energy. The automatic damper also includes an interlock for preventing burner operation unless the damper is in an open position. More specifically, the interlock is adapted to interrupt the electrical power supplied to the main flow and pilot valves (either directly or through the igniter/controller) when the damper is closed, thereby causing the main flow and pilot valves to move to their closed, no-flow positions. Further, the damper is spring loaded and will return to an open position in response to a power failure, thereby enabling the normal chimney draft to effectively vent any unburned gas that may have accumulated. Secondary to the above considerations, the automatic damper advantageously increases the efficiency of the gas log fireplace system by reducing heat loss due to the natural draft of an associated chimney. Generally, during the installation of the automatic damper, the pre-existing manually operated damper is either completely removed or permanently locked in its open position.

A thermally actuated vent damper, such as those manufactured by AMERI-THERM may also be incorporated into the gas log fireplace system of the instant invention. More specifically, the thermally actuated vent damper includes four bi-metal quadrants that are adapted to remain in mutually closed positions when the gas burner is not in operation. Upon ignition of the gas burner via the electrically actuated main flow and pilot valves, the hot flue gases reach the damper, causing the bi-metal quadrants to rapidly extend to an open position, thereby allowing the hot flue gases to safely flow upwards through the chimney.

The thermally actuated vent damper is mounted to a galvanized steel sheet metal hood which has been suitably secured to an upper portion of the firebox area, wherein the vent damper is adapted to project upward into the throat of the flue. As with the automatic damper described above, the pre-existing, manually operated damper must be completely removed or secured in a permanently open position within the flue. Again, the thermally actuated vent damper increases the efficiency of the gas log fireplace system by preventing back drafts of cold air from flowing down the chimney into the living area of a house, by reducing any cooling of the firebox area of the fireplace and by reducing the loss of heated room air.

The present invention provides an externally mounted carbon monoxide detector, such as the COSTAR Carbon Monoxide Detector Model 12S-i, for terminating or inhibiting gas combustion in response to an unsafe level of detected carbon monoxide. More specifically, the carbon monoxide detector includes a chemi-optical sensor for activating an alarm relay after sensing an unsafe level of carbon monoxide over a predetermined period of time. For example, a relatively low level of 50 parts per million of carbon monoxide will activate the alarm relay in approximately eight hours. Correspondingly, higher detected levels of carbon monoxide will necessarily activate the alarm relay after a shorter period of time. In response to the activation of the alarm relay, an optional audible alarm will sound and the igniter/controller will initiate the closure of the main flow and pilot valves. After the carbon monoxide level has decreased to an acceptable, safe level as determined by the carbon monoxide detector, the igniter/controller will permit the reactivation of the main flow and pilot valves via the wall mounted switch. Alternately, in response to the activation of the alarm relay, the electrical power supplied to the igniter/controller may be interrupted by an appropriately wired switch member or the like, thereby causing the main flow and pilot valves to move to their closed, no-flow states. Again, after the dangerous carbon monoxide level has decreased sufficiently, the carbon monoxide detector will reestablish electrical power to the igniter/controller.

The instant invention can be easily retrofitted into an existing fireplace. In an alternate embodiment, the automatic damper includes a shape which conforms to the flue for ease of installation during the retrofit. The existing flue can be used and the wall switch for the igniter/controller and the carbon monoxide detector can be conveniently located within the living area of the home. Further, the valves and computerized igniter/controller are located exterior to the fireplace firebox and brick containment materials and in this way are not exposed to the deleterious high heat conditions found in the region of the firebox. Advantageously, in this type of installation, the unit can be used as a significant source of heat with a heat output of up to approximately 38,000 BTU's. More specifically, by externally placing the controlling apparatus of the present invention a distance away from the high temperatures of the fireplace's firebox area, larger pipes may be utilized to increase the gas flow to the burner, thereby increasing the heating capacity of the system.

The gas log fireplace system of the present invention can meet all codes and requirements for pilotless devices. It can be sized to provide both aesthetic appeal and significant heating capacity. The utilization of a plurality of independently operating safety systems, including a remote temperature actuated switch, an automatic damper and a carbon monoxide detector, provide the gas log fireplace system of the present invention with a factor of safety unequaled by the prior art.

BRIEF DESCRIPTION OF THE DRAWINGS

These and other features of the present invention will become readily apparent upon reading the following detailed description and upon reference to the drawings in which:

FIG. 4 illustrates the mounting of a thermally actuated vent damper within the fireplace flue;

FIG. 5 illustrates the thermally actuated vent damper of FIG. 4 with the bi-metal quadrants in their closed positions; and FIG. 6 illustrates the thermally actuated vent damper of FIG. 4 with the bi-metal quadrants in their open positions.

DETAILED DESCRIPTION OF THE INVENTION

Figure 1:
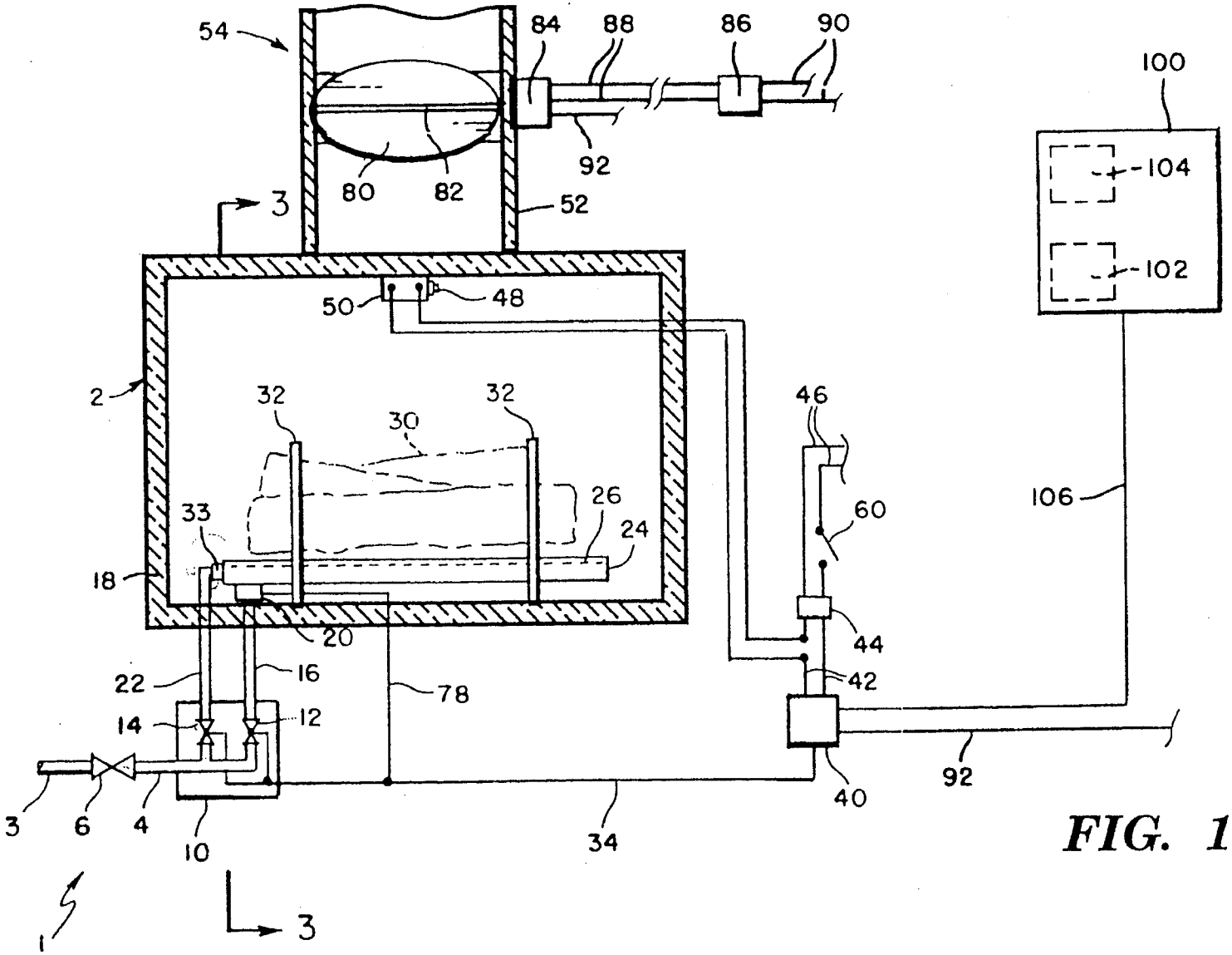
FIG. 1 provides a frontal view of the gas log fireplace system of the present invention with portions shown in schematic form.

Referring now to the drawings in greater detail, there is illustrated a gas log fireplace system, generally designated as 1, that is retrofitted into a pre-existing, conventional fireplace 2, wherein like reference numerals refer to like components throughout the drawings.

Figure 3:
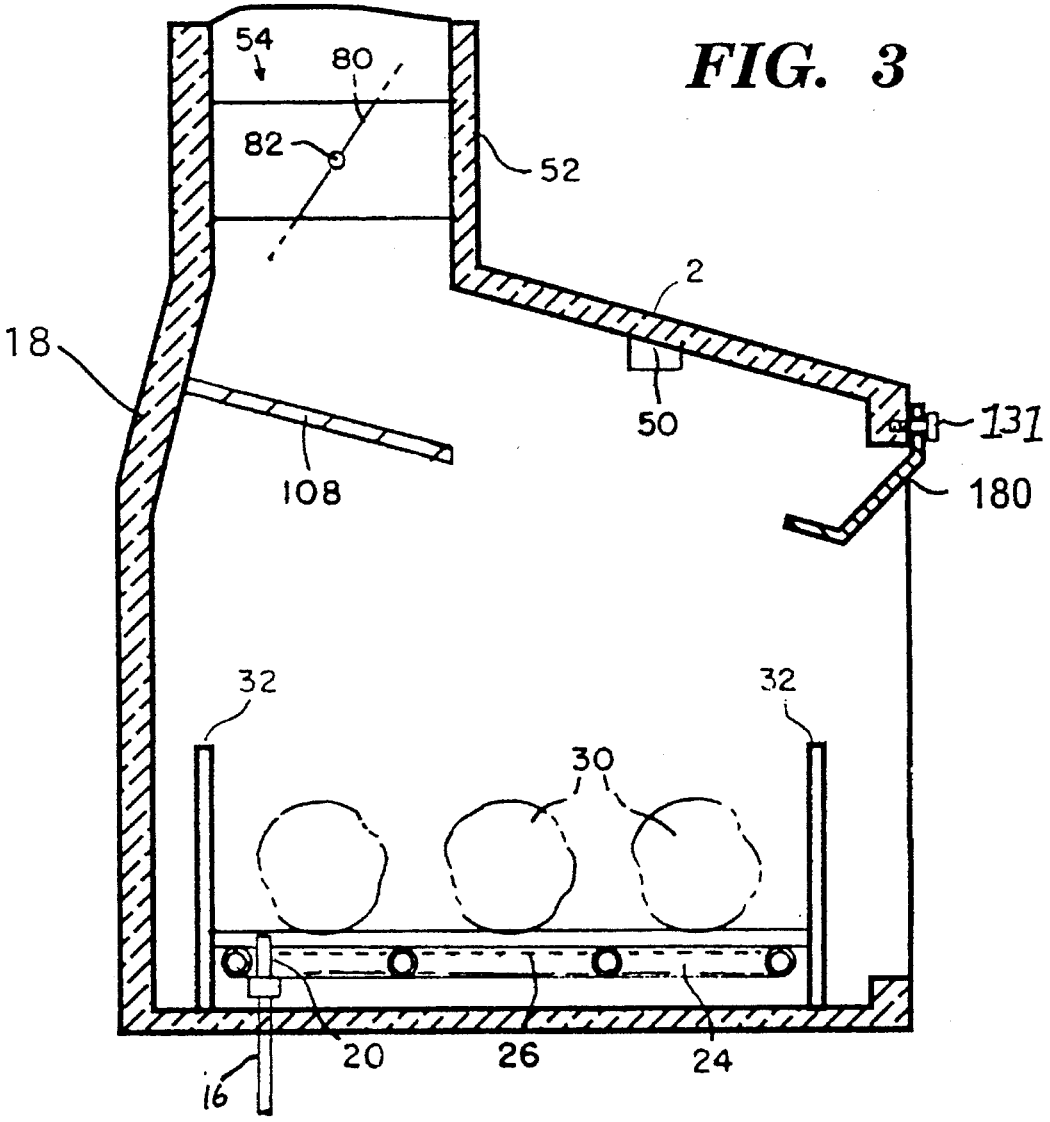
FIG. 3 is a side view of the fireplace illustrated in FIG. 1.

As illustrated in detail in FIGS. 1 and 3, the gas log fireplace system of the present invention is connected to the home gas line 3 by an inlet pipe 4. A conventional manual shut-off valve 6 is utilized to link the home gas line 3 to the inlet pipe 4. The inlet pipe 4 extends to a valve unit 10 comprising two electrically actuated gas flow control valves 12 and 14.

Pilot gas flow control valve 12 is positioned between the main gas inlet 4 and pilot tube 16. The pilot tube passes through the firebox containment material, brick or its equivelant, 18 and leads to the pilot light unit 20. The firebox brick containment material 18 extends upwardly and forms the walls of the flue and chimney.

Inlet gas flow control valve 14 selectively joins inlet pipe 4 to the manifold input pipe 22. This pipe also passes through the containment material 18 and extends to a manifold assembly 24 that includes a plurality of closely spaced gas outlet orifices 26. These orifices lie beneath a plurality of synthetic ceramic logs 30 that are maintained in position by stanchions 32. At least one of the gas outlet orifices 26 is disposed adjacent the pilot light unit 20.

Located between the end of the manifold inlet pipe 22 and the entrance to the manifold assembly 24 is a modified mixer orifice 33. The mixer orifice is substantially identical to a standard LP (liquid petroleum) mixer orifice in that it includes a center orifice and a plurality of air inlet holes that are adjustably covered by a manually movable nut. The standard mixer orifice is modified by drilling out the orifice with a #35 drill bit until it has a diameter of approximately seven sixty-fourths of an inch. This is significantly greater than its original diameter. By utilizing such a mixer orifice, one can use natural gas as a fuel and adjust the air fuel mixture to the gas outlet orifices 26 to significantly improve the burn characteristics of the system.

The electrically actuated gas flow control valves 12 and 14 are electrically coupled via wiring harness 34 to an igniter/controller module 40 that is located exterior to the insulating brick containment material 18. The module 40 provides the electrical power required to move these valves between their closed and open positions. The pilot light unit 20 is also electrically connected by the wiring harness 34 to the igniter/controller module 40, via wire 78.

The igniter/controller module 40 is coupled by wires 42 to a 24 volt transformer 44. The transformer is connected to the house electric lines by wires 46. In a typical installation, the module 40 is a HONEYWELL model Y86 unit or the like.

A temperature actuated switch 50 is located adjacent the fireplace chimney flue 52 and is electrically connected to the ignition/controller module 40 via a loop in one of the wires 42. Preferably, the flue 52 encloses an automatic, electric damper 54. As is readily apparent in FIG. 1, the temperature actuated switch 50 is wired in series with the module 40. Consequently, an open circuit produced by the temperature actuated switch 50 will interrupt the electrical power supplied to module 40. Preferably, the temperature actuated switch 50 is a MARS Company model 39043 or the like. It includes a manual reset switch with a button 48.

A manually operated switch 60, illustrated schematically in FIG. 1, provides the user with a simple control over the gas log fireplace system. The switch is electrically connected to the module 40 via the wires 46 that lead to the transformer 44. Preferably, the switch 60 would be installed on a wall within a few feet of the fireplace.

As detailed above, the flue 52 incorporates an automatic, electric damper 54 for controlling the passage of air therethrough in response to the combustion of the gas exiting the gas outlet orifices 26 in the manifold 24. The damper 54 includes a rotatable damper vane 80, which is adapted to pivot between an open and closed position about pivot member 82, and a damper controller 84 (including a motor) for regulating the operational rotation of the damper vane 80. The damper controller 84 is suitably coupled to a 24 volt transformer 86 via wires 88, with transformer 86 connected to the house electric lines by wires 90. Further, the damper 54 is electrically connected by a wiring harness 92 to the igniter/controller module 40. When gas combustion is required, the igniter/controller module provides the automatic damper with an "open" signal. In response thereto, the damper vane 80 is rotated to its open position by damper controller 84. Thereafter, gas combustion is initiated as detailed below. When gas combustion ceases, the damper 54 is returned to a closed position, thereby preventing the passage of air through the flue 52. The damper controller further includes an interlock (not shown) for preventing burner operation unless the damper vane 80 is in the required operational open position. Such a condition may occur if the damper vane is blocked open by debris or the like or in response to an inoperative or malfunctioning damper vane closing mechanism.

As illustrated in FIGS. 4, 5 and 6, a thermally actuated vent damper 94 may be utilized in lieu of the automatic, electric damper described above. The thermally actuated vent damper 94 includes a plurality of bi-metal quadrants 96 mounted therein that are adapted to remain in mutually closed positions when the gas burner is not in operation, thereby preventing the flow of air through the flue 52. After the gas has been ignited, the hot flue gases come into contact with the bi-metal quadrants 96 which rapidly flex to their open positions as illustrated in FIG. 6, allowing the flue gases to pass upwards through the chimney. Preferably, the thermally actuated vent damper 94 is mounted upon a galvanized steel sheet metal hood 98 which has been suitably secured to an upper portion of the fireplace's firebox area.

Figure 8:
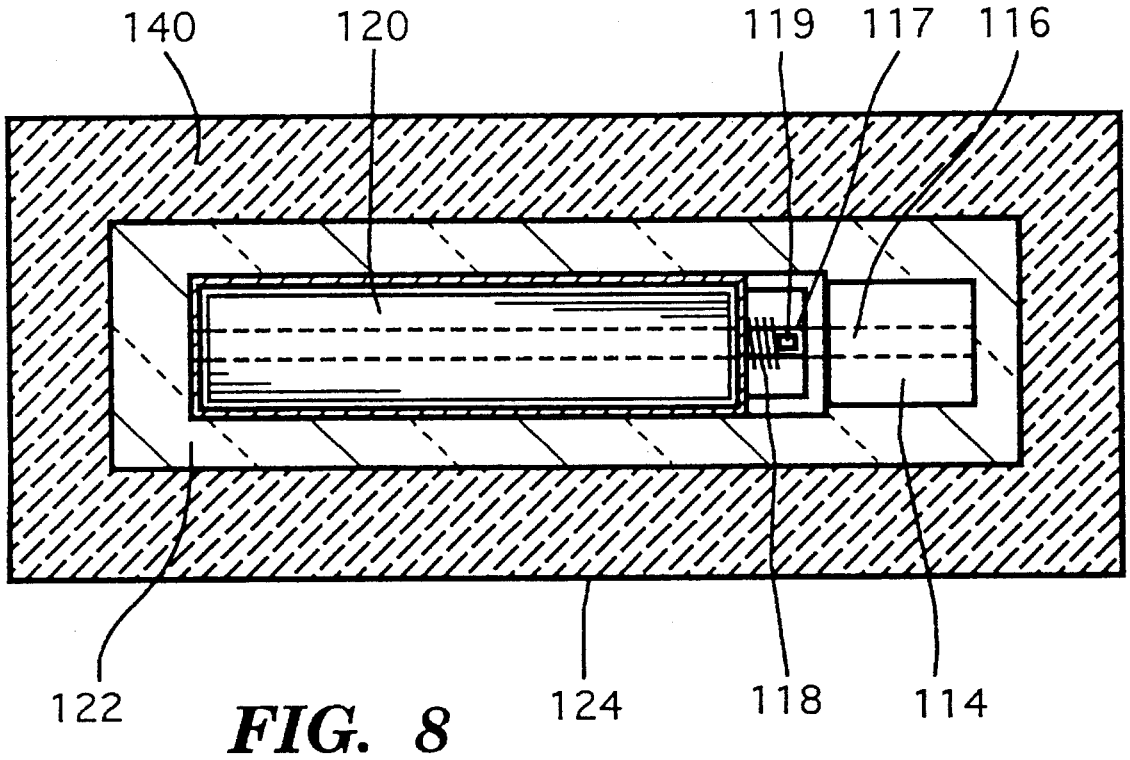
FIG. 8 is a top view of the rectangular damper system in a chimney flue.
Figure 7:
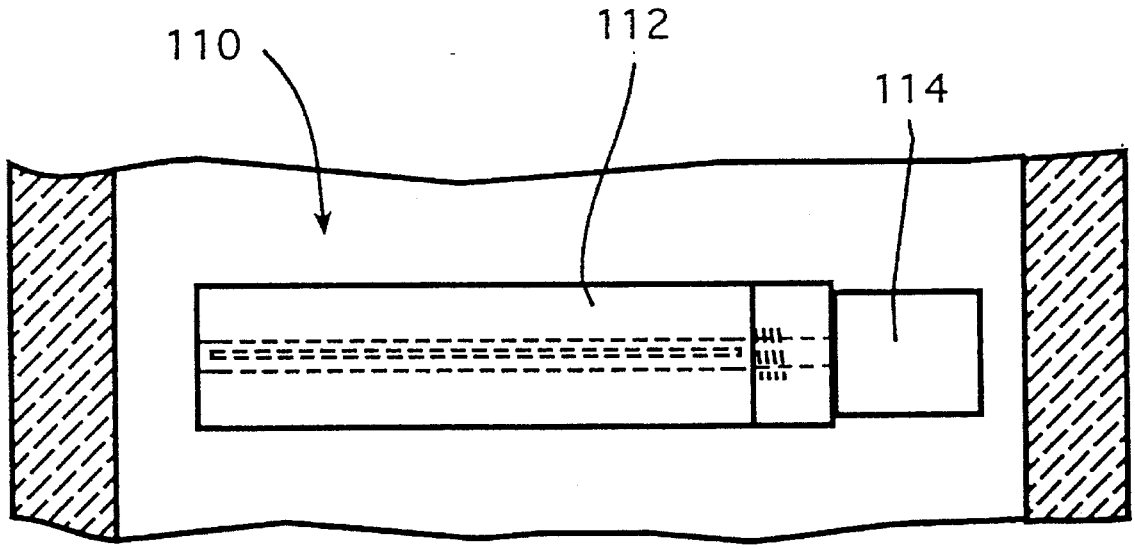
FIG. 7 is a side view of the rectangular damper system.

An alternative, rectangular damper system 110 is shown in FIGS. 7 and 8. The rectangular damper system 110 includes a motor 114 coupled by an electric motor drive shaft 116 to the damper panel drive shaft 117.

The electric motor drive shaft 116 is coupled to the damper panel drive shaft 117 with a key 119. The electric motor 114, electric motor drive shaft 116, and key 119 are components of the FLAIR SL19 motorized vent damper. If the electric motor 114, or the coupling between the motor 114 and damper panel drive shaft 117, fails, the damper panel 120 will be displaced to its open position by a spring 118. This spring 118 is connected to both the damper panel drive shaft 117 and the damper housing 112. The spring 118 is mounted around the damper panel drive shaft 117 like in the FLAIR SL19 unit. A damper housing 112 encloses the damper panel 120. The rectangular damper system 110 is placed in a flue 124 with a rectangular cross section in a lieu of a mechanical damper. Any pre-existing mechanical damper in the flue 124 is disconnected or removed upon insertion of the damper system 110. Regions of the flue 124 about the damper system 110 are filled with thermal insulation 122 to prevent heat loss.

Figure 10:
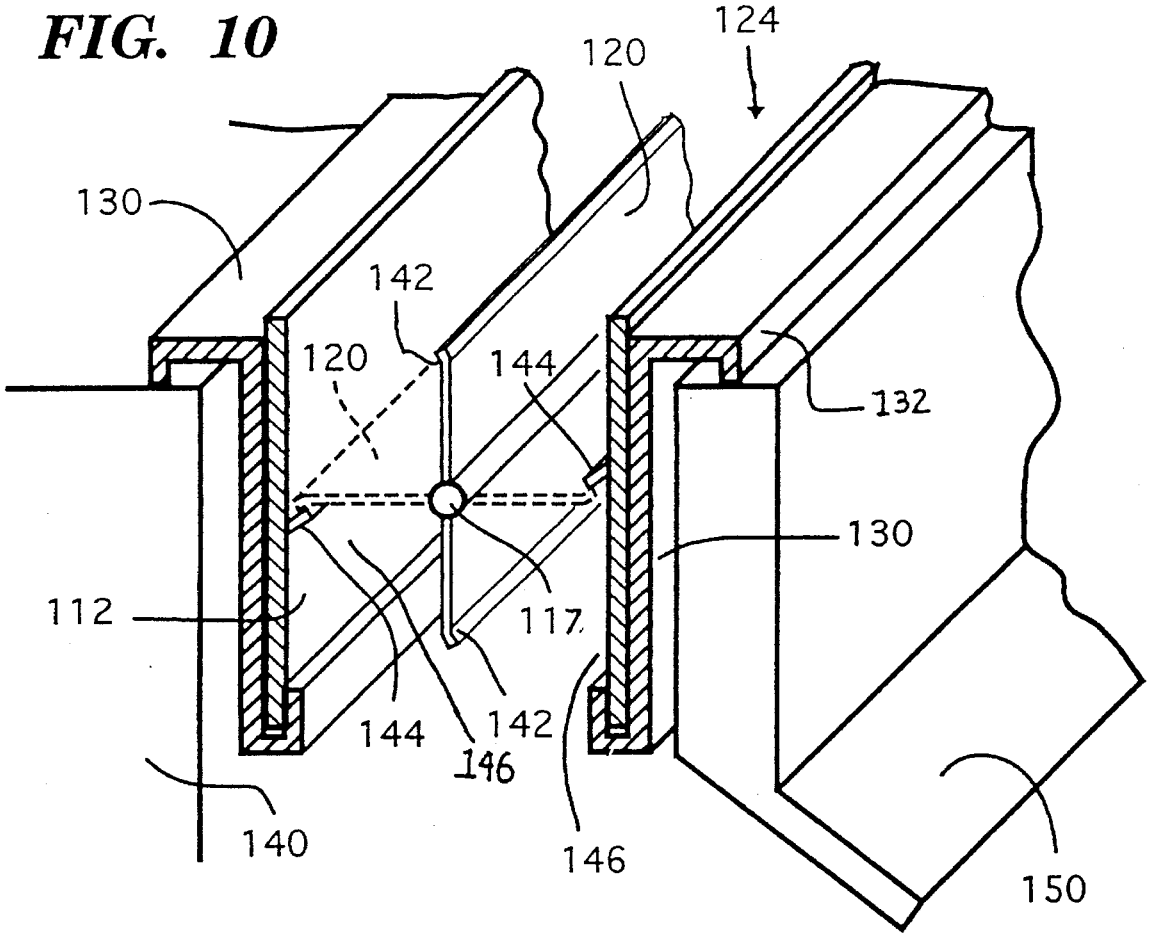
FIG. 10 is an isometric view of the rectangular damper system in a chimney flue.
Figure 9:
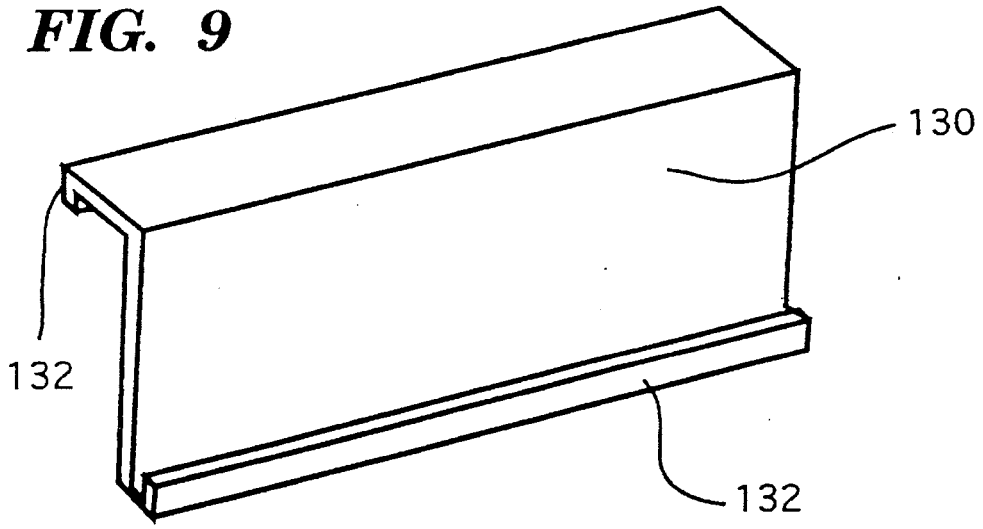
FIG. 9 is an isometric view of hanger for the rectangular damper enclosure.

References are now made to FIGS. 9 and 10. The damper housing 112 is mounted in the flue 124 with damper housing mounting hangers 130. Hanger lips 132 on each end of the hangers 130 lock into the damper housing 112 and mount over the lip of a firewall 140 or smoke hood 150, or is attached to the flue 124 by masonary screws.

The damper panel 120 is centrally mounted on the damper panel drive shaft 117 within the damper housing 112. The damper panel 120 has damper panel ends 142 that are bent at about fifteen degree angles. Damper housing flanges 144 are attached to the center of the damper housing walls 146 parallel to the flue walls. The flanges 144 are also bent at about a fifteen degree angles.

When the fireplace system 1 commands the damper system 110 to open, the damper panel 120 is rotated by the electric motor 114 so that the damper panel 120 is parallel to the firewalls 140. As a result maximum exhaust gas flow is permitted through the damper system 110. When the fireplace system 1 commands the damper system 110 to close, the damper panel 120 is rotated by the electric motor shaft 116 to a position perpendicular to that of the firewalls 140. In this closed position the damper panel ends 142 mate with the bent damper housing flanges 144 to provide a tight seal to reduce heat loss through the flue to the environment.

Figure 11:
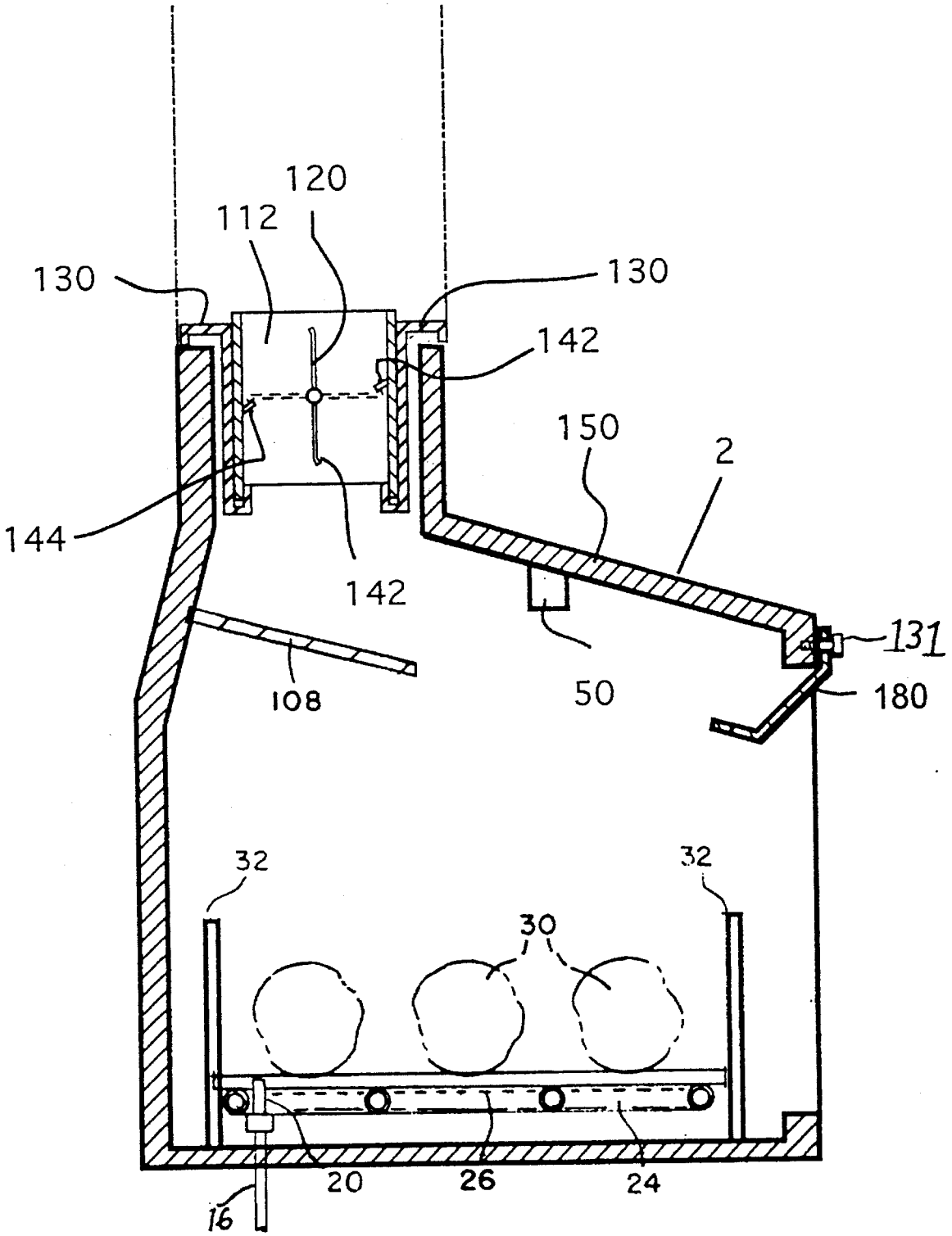
FIG. 11 is a side view of the rectangular damper system in a fireplace.
Figure 12:
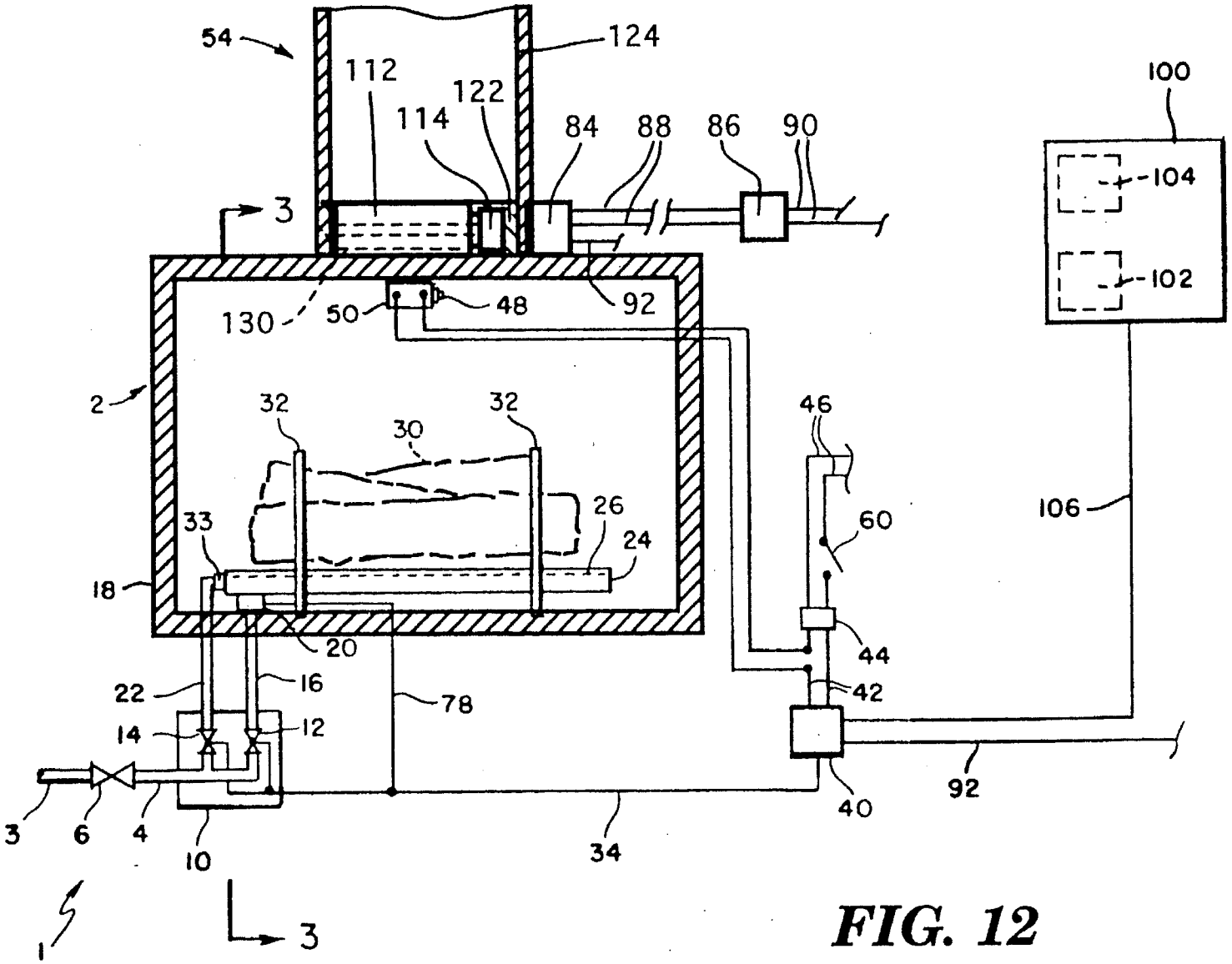
FIG. 12 is a frontal view of the gas log fireplace system with the rectangular damper system.

FIG. 11 is a side view of the fireplace 2 with a rectangular damper system 110. FIG. 12 is a frontal view of the rectangular damper system 110 with the fireplace system 1.

References are now made again to FIG. 1. A carbon monoxide detector 100, mounted within the living area of the home exterior to the fireplace 2, is provided to terminate or inhibit gas ignition and/or combustion in response to an unsafe level of detected carbon monoxide. The carbon monoxide detector 100 includes an alarm relay 102 which is activated after an unsafe level of carbon monoxide is detected by a carbon monoxide sensor 104 over a predetermined period of time. In response to the activation of the alarm relay 102, an alarm signal is transmitted to the igniter/controller module 40 over wire 106, thereby initiating the shut down of the pilot gas flow control valve 12 and inlet gas control valve 14. After the sensor 104 has determined that the level of carbon monoxide within the living area has decreased to a safe level, the alarm signal is terminated, thereby allowing the igniter/controller module 40 to reinitiate gas combustion in response to the actuation of switch 60.

Figure 2:
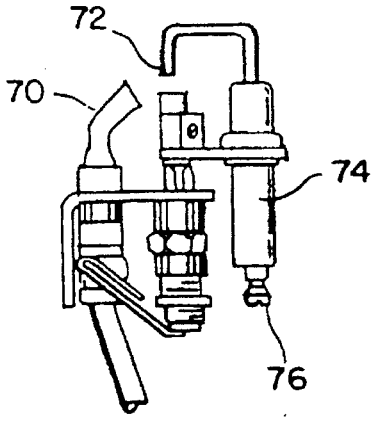
FIG. 2 PRIOR ART
FIG. 2 is a front view of the pilot ignition unit.

The pilot light unit 20 is shown in greater detail in FIG. 2. The unit comprises a pilot light outlet nozzle 70 and a sparkplug igniter 72. There is also a thermocouple type heat sensor located within an igniter/sensor rod 74. The igniter 72 would be connected at tip 76 to the module 40 by a heat resistant wire 78 (see FIG. 1) which runs to the wiring harness 34.

In operation, the manual shut-off valve 6 would normally be in an open condition whereby gas is allowed to pass to the valve unit 10. To start the unit, the operator would actuate switch 60 to its "on" position. This would cause the module 40 to open pilot gas flow control valve 12 which allows gas to flow through pipe 16 to the pilot light outlet nozzle 70. At the same time, the module 40 sends an intermittent electric current through wire 78 to initiate a sparking of the igniter 72. Once the pilot lights, a small current will be created between the pilot light unit and ground due to the heat of the pilot flame acting on the thermocouple. The igniter/controller module 40 senses this current and then performs two functions. First, it stops sparking the igniter. Next, the module sends a signal to the inlet gas control valve 14 which causes the valve to open.

After valve 14 opens, gas begins to flow through the manifold input pipe 22 into the manifold 24. The gas exits the manifold through the orifices 26. The exiting gas is initially ignited by the pilot and, once lit, the burning of the gas is sustained until the unit is shut down. The burning gas rises upward and passes through and around the ceramic logs 30, thereby simulating a wood fire.

When the user desires to turn the unit off, he or she merely places switch 60 in its "off" (open circuit) position as illustrated in FIG. 1. This causes the module 40 to stop emitting "open" signals to valves 12 and 14, thereby immediately moving these valves to their closed position. The flame is extinguished as the last of the gas is exhausted and the unit is then in its shutdown condition.

During normal operating conditions when the automatic damper 54 is open, the heat from the fire will pass upwardly through the flue, thereby minimizing the temperature to which the top of the firebox is heated. However, if the automatic damper malfunctions and remains closed when the unit is in operation, the above temperature conditions increase significantly.

The air heated by the burning gas and the resultant gas combustion products will continue rising toward the flue even if the damper therein is closed. Instead of flowing upwards through the chimney, the gases will collect at the top of the firebox and spill outwardly into the living area of the home.

Due to the change in air/gas flow within the firebox, the top of the firebox proximate the flue is heated to a temperature significantly greater than 400° F. Should this occur, the temperature actuated switch 50 is tripped to its open circuit position. In this mode, electrical current cannot pass through the switch 50 to the igniter/controller module 40, thereby simulating the "off" position of switch 60. The electrically actuated valves 12 and 14 immediately move to their closed position and the unit shuts down.

The temperature actuated switch 50 includes a manual reset button 48 that it can be operated by the user to reset the switch. Once reset, the switch will again allow the passage of electrical current to the module 40. Since manual resetting of the switch 50 is required prior to operation of the unit, the user would be alerted to the fact that the automatic damper 54 has malfunctioned so that appropriate repairs and the like may be performed.

To retrofit an existing brick or masonry fireplace with a gas log fireplace system in accordance with the invention, the following procedure is normally followed.

Initially, the fireplace is fully cleaned and the irons are removed. Next, exterior access to the firebox area of the fireplace is obtained by drilling a hole through the insulating brick containment material 18 of one of the brick walls that surround the firebox.

Next the fireplace is modified for optimum use of the gas burner apparatus. After completely removing the pre-existing manually operated damper or permanently locking it in an open position, the automatic electric damper 54 is installed in the fireplace flue 52 and is suitably wired to the electrical wiring of the home and to the igniter/controller 40. Further, the temperature actuated switch 50 is installed within the firebox proximate the flue opening and connected in series with the module 40.

The gas flow control valves 6, 12 and 14 and the igniter/controller module 40 are installed exterior to the fireplace 2 in a location where they will not be exposed to temperatures substantially higher than the ambient room temperature. In practice, the valves and module are normally located two or three feet from the fireplace in either an adjacent wall or cabinet or within the basement of the home. Similarly, the carbon monoxide detector 100 is installed exterior to the fireplace 2 on a ceiling or wall at least 5 feet above the ground and wired to the igniter/controller module.

The igniter/controller module 40 is then connected to the home's electrical wiring and the gas flow control valves are connected to a source of natural gas. At this time, pipes 16 and 22 and wire 78 are appropriately connected and are extended through the hole in the insulating brick containment 18 into the firebox area.

The gas burner apparatus including the manifold assembly 24, pilot light unit 20 and mixer orifice 33 are then placed within the firebox area of the fireplace. Appropriate connections are made to pipes 16 and 22 and wire 78 is connected to the pilot light unit 20. All of the connections are then tested. Once complete, the gas burner apparatus is ready for use.

A back draft diverter screen 108 may be incorporated into the fireplace system of the present invention to prevent a downwardly directed back draft of air from directly contacting the gas burning apparatus while the damper 54 is in an open state. More specifically, as illustrated in FIG. 3, the back draft diverter 108 may be secured to the back wall of the wood burning fireplace 2 directly under the flue 52.

In order to reduce the formation of carbon deposits on the plurality of synthetic ceramic logs 30 during the operation of the gas burning apparatus, and thereby increase the cleanliness of the resultant gas combustion products, the logs 30 may be arranged so that the flames extending upward from the manifold assembly 24 do not impinge thereon. Such a log arrangement is illustrated in FIG. 3.

FIGS. 3 and 11 disclose a hearth opening modification shield 180. The hearth modification opening shield 180 is a sheet metal lip that may be mounted across the front upper opening of the fireplace mouth. If the fireplace has difficulty drawing off the gas products of combustion, the adjustable hearth opening modification shield 180 may be used. The hearth opening modification shield 180 fits across the entire upper front of the hearth mouth. The shield 180 may be lowered or raised depending on draw needs by adjustable bolts through which pressure screws 131 are mounted. The shield fits up behind glass doors between the masonary and the back of the glass doors. Optionally, the shield may be mounted with masonary screws or industrial glue.

The foregoing description of the preferred embodiments of the invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims.

I claim:

1. A gas burning fireplace system for a wood burning fireplace having a central firebox area partially surrounded by walls, said walls extending upwardly to form a flue and a chimney, said central firebox area further including an inner hearth and an opening extending into the interior of a building, said system comprising:

an automatic damper, disposed within said flue and having means for automatically opening said flue when said central firebox area is ignited and means for automatically closing said flue when said central firebox area is not ignited, said automatic damper thereby enhancing the flow of exhaust from said fireplace and up said flue;

a gas burning system retrofitted into said central firebox area, and including:

a gas inlet conduit;

a gas manifold having at least one outlet hole, connected to said gas inlet conduit;

a pilot light operatively connected to said gas manifold;

a first electrically actuated gas flow valve operatively connected to said gas inlet conduit, to control the flow of gas to said gas manifold;

a second electrically actuated gas flow valve operatively connected to said gas inlet conduit and to said pilot light, to control the flow of gas to said pilot light;

an electronic ignitor operatively connected to said pilot light and said first and second electrically actuated valves; and switch means, operatively connected to said electronic ignitor, whereby said first and second electrically actuated valves are opened, causing gas to flow through said gas inlet conduit, into said gas manifold to be ignited and released out said at least one outlet hole; and means for detecting the carbon monoxide level within said interior of a building, disposed outside said fireplace, operatively connected to said electronic ignitor and having means to automatically terminate gas flow and ignition within said gas burning system in response to a predetermined carbon monoxide level within said interior of a building.

2. The gas burning fireplace system according to claim 1 further including:

a temperature actuated switch means, operatively connected to said first and second electrically actuated valves, whereby said first and second electrically actuated valves are closed and the flow of gas within said gas burning system terminated in response to a predetermined temperature within said fireplace.

3. The gas burning fireplace system according to claim 1 further including:

a plurality of simulated log members; and means for arranging said log members above said gas manifold to prevent a gas flame extending upward from said at least one outlet hole in said gas manifold from impinging said log members.

4. The gas burning fireplace system of claim 1 wherein said automatic damper further comprises a damper housing, conforming to the shape of said flue, to facilitate the retrofit of said automatic damper and to lessen heat loss up said flue.

5. The gas burning fireplace system of claim 1 further including:

an hearth opening shield mounted across the upper edge of said fireplace opening to facilitate the drawing off of by-products of gas combustion.

6. A gas burning fireplace system for a wood burning fireplace having a central firebox area partially surrounded by walls, said walls extending upwardly to form a flue and a chimney, said central firebox area further including an inner hearth and an opening extending into the interior of a building said system comprising:

an automatic damper, disposed within said flue and having means for automatically opening said flue when said central firebox area is ignited and means for automatically closing said flue when said central firebox area is not ignited, said automatic damper thereby enhancing the flow of exhaust from said fireplace and up said flue;

a hanger apparatus, for retrofitting said automatic damper into said flue, comprised of a downwardly extending surface having a first end and a second end, said first and second ends bent in opposing directions to form lips, whereby said hanger is inserted into and affixed to said flue thereby forming a shelf to hold said automatic damper; and a gas burning system retrofitted into said central firebox area, and including:

a gas inlet conduit;

a gas manifold having at least one outlet hole, connected to said gas inlet conduit;

a pilot light operatively connected to said gas manifold;

a first electrically actuated gas flow valve operatively connected to said gas inlet conduit and to said pilot light, to control the flow of gas to said pilot light;

an electronic ignitor operatively connected to said pilot light and said first and second electrically actuated valves; and switch means operatively connected to said electronic ignitor whereby said first and second electrically actuated valves are opened, causing gas to flow through said gas inlet conduit, into said gas manifold to be ignited and released out said at least one outlet hole.

7. A gas burning fireplace system for a wood burning fireplace having a central firebox area partially surrounded by walls, said walls extending upwardly to form a flue and a chimney, said central firebox area further including an inner hearth and an opening extending into the interior of a building, said system comprising:

an automatic damper, disposed within said flue and having means for automatically opening said flue when said central firebox area is ignited and means for automatically closing said flue when said central firebox area is not ignited, said automatic damper thereby enhancing the flow of exhaust from said fireplace and up said flue;

a gas burning system retrofitted into said central firebox area, and including:

a gas inlet conduit;

a gas manifold having at least one outlet hole, connected to said gas inlet conduit;

a pilot light operatively connected to said gas manifold;

a first electrically actuated gas flow valve operatively connected to said gas inlet conduit, to control the flow of gas to said gas manifold;

a second electrically actuated gas flow valve operatively connected to said gas inlet conduit and to said pilot light, to control the flow of gas to said pilot light;

an electronic ignitor operatively connected to said pilot light and said first and second electrically actuated valves; and switch means operatively connected to said electronic ignitor whereby said first and second electrically actuated valves are opened, causing gas to flow through said gas inlet conduit, into said gas manifold to be ignited and released out said at least one outlet hole; and means for detecting the carbon monoxide level within said interior of a building, disposed outside said fireplace, operatively connected to said electronic ignitor and having means to automatically terminate gas flow and ignition within said gas burning system in response to a predetermined carbon monoxide level within said interior of a building;

a temperature actuated switch means, operatively connected to said first and second electrically actuated valves, whereby said first and second electrically actuated valves are closed and the flow of gas within said gas burning system terminated in response to a predetermined temperature within said fireplace;

a back draft diverter element mounted on one of said walls of said central firebox area, opposite said opening and substantially underneath said flue;

an adjustable mixer orifice located between said gas inlet conduit and said gas manifold for adjustably admitting air into said gas manifold;

a plurality of simulated log members; and means for arranging said log members above said gas manifold such that a gas flame extending upwardly from said at least one outlet hole does not impinge upon said log members.

8. The gas burning fireplace system of claim 7 wherein said automatic damper further comprises a damper housing, conforming to the shape of said flue, to facilitate the retrofit of said automatic damper and to lessen heat loss up said flue.

9. The gas burning fireplace system of claim 7, further including:

an hearth opening shield mounted across the upper edge of said fireplace opening to facilitate the drawing off of by products of gas combustion.

* * * * *